US006117828A

United States Patent [19]

Puvvada et al.

[11] Patent Number: 6,117,828

[45] Date of Patent: Sep. 12, 2000

[54] HANDWASH COMPOSITIONS

[75] Inventors: Sudhakar Puvvada, Shelton, Conn.; Michael Slayton, Mount Arlington, N.J.

[73] Assignee: Unilever Home & Personal Care USA, Greenwich, Conn.

[21] Appl. No.: 09/347,336

[22] Filed: Jul. 2, 1999

[51] Int. Cl.[7] ..... C11D 1/02; C11D 1/94; C11D 3/26; C11D 3/48

[52] U.S. Cl. ..... 510/124; 510/123; 510/125; 510/127; 510/131; 510/137; 510/138; 510/151; 510/155; 510/158; 510/159; 510/382; 510/383; 510/504; 510/505; 510/156; 424/70.11; 424/70.14; 424/70.21; 424/70.22; 424/70.28; 424/70.31; 424/70.17; 514/846

[58] Field of Search ..... 510/125, 123, 510/124, 131, 137, 138, 151, 155, 158, 159, 382, 383, 504, 505, 127, 156; 424/70.11, 70.14, 70.22, 70.21, 70.28, 70.31, 70.17; 514/846

[56] References Cited

U.S. PATENT DOCUMENTS

| | | | |
|---|---|---|---|
| 3,723,325 | 3/1973 | Parran, Jr. | 252/106 |
| 4,031,307 | 6/1977 | DeMartino et al. | 536/114 |
| 4,438,095 | 3/1984 | Grollier et al. | 424/70 |
| 4,565,647 | 1/1986 | Llenado | 252/354 |
| 5,009,814 | 4/1991 | Kelkenberg et al. | 252/548 |
| 5,389,279 | 2/1995 | Au et al. | 252/108 |
| 5,393,466 | 2/1995 | Llardi et al. | 252/549 |
| 5,556,615 | 9/1996 | Janchitraponvej et al. | 424/70.11 |

*Primary Examiner*—Gregory N Delcotto
*Attorney, Agent, or Firm*—Ronald A. Koatz

[57] ABSTRACT

The invention discloses handwash or personal wash shampoo compositions comprising surfactant(s), cationic wheat protein and an antibacterial agent. The cationic wheat protein provides enhanced skin feel relative to other proteins.

10 Claims, No Drawings

HANDWASH COMPOSITIONS

FIELD OF THE INVENTION

The present invention relates to liquid handwash compositions. In particular, it relates to surfactant containing handwash comprising cationic wheat protein (e.g., as skin benefit agent and/or structurant). Preferably, compositions also contain a bacteriocide.

BACKGROUND OF THE INVENTION

A number of objectives must be met when formulating handwash compositions.

While it is important that these compositions contain a good cleansing surfactant system (generally containing at least one anionic surfactant and preferably at least an additional amphoteric surfactant), such compositions should ideally also contain a component beneficial to the skin, e.g., component which will counteract the "dry" feeling associated with a good cleansing surfactant. The art is thus always on the lookout for such good moisturizing ingredients. Examples of moisturizing ingredients used in the art include guar, proteins, silicones, esters etc. It should be noted that many of these moisturizers leave the hand feeling moisturized but do not also provide a "clean" feeling. For handwash such "clean" feeling is very important.

Unexpectedly, applicants have found that combination of surfactants and cationic wheat protein provide excellent moisturizing feel relative to combination of surfactants, and other types of proteins. In addition, they leave hands feeling clean. Use of antibacterial agent for enhanced effect is especially preferred and, applicants believe, combination of antibacterial and cationic wheat protein is novel to the art.

BRIEF DESCRIPTION OF THE INVENTION

The present invention relates to handwash compositions, particularly those comprising mixture of anionic and amphoteric surfactants containing a specific skin benefit agent (e.g., cationic wheat protein) which provides unexpectedly good moisturizing feel relative to other proteins while simultaneously maintaining a clean feeling. Use of such protein in an antibacterial handwash in particular is believed to be novel to the art.

Specifically, the composition comprises:

(1) 3 to 40% by wt. of a surfactant selected from the group consisting of anionic, nonionic and amphoteric/zwitterionic surfactants and mixtures thereof;

(2) 0.01 to 5%, preferably 0.05 to 2% by wt. of a cationic wheat protein; and (3) 0.01 to 3% by wt. antibacterial agent (e.g., Triclosan);

wherein said wheat protein has a structure defined as follows:

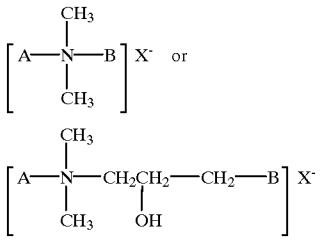

wherein A is

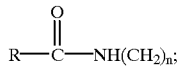

or $CH_3(CH_2)_m$;

wherein R is $CH_3(CH_2)_m$;

n=0 to 5; and m=8 to 22;

B is hydrolyzed wheat protein and $X^-$ is an anion such as for example chloride, bromide or other halogen.

In preferred embodiment,

A (in second of the two structures) is

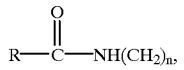

where

R is the fatty group derived from wheat germ oil (e.g., mixture of various fatty acids)

n=1 to 5;

Also, in preferred embodiment, $X^-$ is $Cl^-$.

Preferably, the composition will also comprise 0.1 to 5% of a humectant such as a low molecular weight alcohol (PEG 800 and below), glycerine, or $C_2$–$C_4$ alkylene glycol.

The composition also preferably contains 0.05 to 5% of a second cationic polymer (e.g., guar).

Viscosity of the compositions is preferably 200 to 25,000 cps, preferably 1000 to 15,000 cps, more preferably 2000 to 10,000 cps, using Brookfield viscometer with Spindle 41 at 0.5 rpm and measured at about 25° centigrade.

DETAILED DESCRIPTION OF THE INVENTION

The present invention relates to handwashing compositions particularly antibacterial handwashing compositions and more particularly to such compositions having enhanced moisturization (e.g. "nondrying") feel.

The compositions of the invention comprise a cleansing surfactant system, particular one comprising mixture of anionic and amphoteric surfactants. The compositions further comprise both an antibacterial agent and a specific cationic wheat polymer which provides the unexpected moisturization effect relative to other cationic proteins.

The compositions are set out in greater detail below.

Surfactant System

The surfactant system of the subject invention comprises 3 to 40% by weight, preferably 5 to 25% by wt. of the composition and comprises:

(a) one or more anionic surfactants;

(b) amphoteric and/or zwitterionic surfactant; and (c) optional nonionic surfactant The anionic surfactant may be, for example, an aliphatic sulfonate, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or an aromatic sulfonate such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably between 2 and 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, and acyl isethionates.

Sulfosuccinates may be monoalkyl sulfosuccinates having the formula:

$$R^4O_2CCH_2CH(SO_3M)CO_2M;$$

amido-MEA sulfosuccinates of the formula $$R^4CONHCH_2CH_2O_2CCH_2CH(SO_3M)CO_2M$$

wherein $R^4$ ranges from $C_8$–$C_{22}$ alkyl and M is a solubilizing cation;

amido-MIPA sulfosuccinates of formula $$RCONH(CH_2)CH(CH_3)(SO_3M)CO_2M$$

where M is as defined above.

Also included are the alkoxylated citrate sulfosuccinates; and alkoxylated sulfosuccinates such as the following:

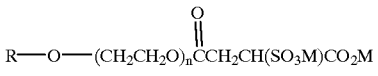

wherein n=1 to 20; and M is as defined above.

Sarcosinates are generally indicated by the formula $RCON(CH_3)CH_2CO_2M$, wherein R ranges from $C_8$ to $C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Another class of anionics are carboxylates such as follows:

$$R\text{-}(CH_2CH_2O)_nCO_2M$$

wherein R is $C_8$ to $C_{20}$ alkyl; n is 0 to 20; and M is as defined above.

Another carboxylate which can be used is amido alkyl polypeptide carboxylates such as, for example, Monteine LCQ® by Seppic.

Another surfactant which may be used are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 0.5–15% by weight of the total composition. Preferably, this component is present from about 1 to about 10%.

The acyl isethionate may be an alkoxylated isethionate such as is described in llardi et al., U.S. Pat. No. 5,393,466, hereby incorporated by reference into the subject application. This compound has the general formula:

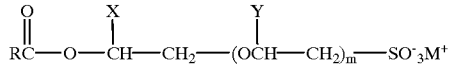

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 1 to 20% by weight of the composition, preferably 2 to 15%, most preferably 5 to 12% by weight of the composition.

Zwitterionic and Amphoteric Surfactants

Zwitterionic surfactants are exemplified by those which can be broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. A general formula for these compounds is:

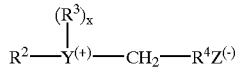

wherein $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing about 1 to about 3 carbon atoms; X is 1 when Y is a sulfur atom, and 2 when Y is a nitrogen or phosphorus atom; $R^4$ is an alkylene or hydroxyalkylene of from about 1 to about 4 carbon atoms and Z is a radical selected from the group consisting of carboxylate, sulfonate, sulfate, phosphonate, and phosphate groups.

Examples of such surfactants include:

4-[N,N-di(2-hydroxyethyl)-N-octadecylammonio]-butane-1-carboxylate;

5-[S-3-hydroxypropyl-S-hexadecylsulfonio]-3-hydroxypentane-1-sulfate;

3-[P,P-diethyl-P-3,6,9-trioxatetradexocylphosphonio]-2-hydroxypropane-1-phosphate;

3-[N,N-dipropyl-N-3-dodecoxy-2-hydroxypropylammonio]-propane-1-phosphonate;

3-(N,N-dimethyl-N-hexadecylammonio)propane-1-sulfonate;

3-(N,N-dimethyl-N-hexadecylammonio)-2-hydroxypropane-1-sulfonate;

4-[N,N-di(2-hydroxyethyl)-N-(2-hydroxydodecyl) ammonio]-butane-1-carboxylate;

3-[S-ethyl-S-(3-dodecoxy-2-hydroxypropyl)sulfonio]-propane-1-phosphate;

3-[P,P-dimethyl-P-dodecylphosphonio]-propane-1-phosphonate; and

5-[N,N-di(3-hydroxypropyl)-N-hexadecylammonio]-2-hydroxy-pentane-1-sulfate.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

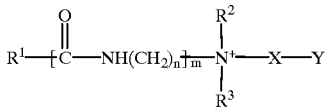

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is2to4;

m is 0 to 1;

X is alkylene of 1 to 3 carbon atoms optionally substituted with hydroxyl, and Y is —$CO_2$— or —$SO_3$—

Suitable amphoteric detergents within the above general formula include simple betaines of formula:

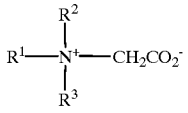

and amido betaines of formula:

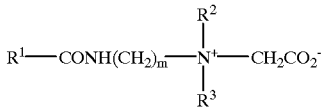

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$are preferably methyl.

A further possibility is that the amphoteric detergent is a sulphobetaine of formula

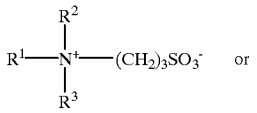

or

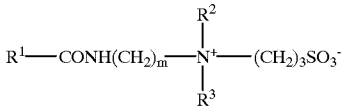

where m is 2 or 3, or variants of these in which —$(CH_2)_3SO_3$ is replaced by

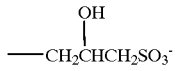

In these formulae $R^1$, $R^2$ and $R^3$ are as discussed previously.

Amphoacetates and diamphoacetates are also intended to be covered in possible zwitterionic and/or amphoteric compounds which may be used.

The amphoteric/zwitterionic generally comprises 0.1 to 20% by weight, preferably 5% to 15% of the composition.

In addition to one or more anionic and amphoteric and/or zwitterionic, the surfactant system may optionally comprise a nonionic surfactant.

The nonionic which may be used includes in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Other surfactants which may be used are described in U.S. Pat. No. 3,723,325 to Parran Jr. and alkyl polysaccharide nonionic surfactants as disclosed in U.S. Pat. No. 4,565,647 to Llenado, both of which are also incorporated into the subject application by reference.

Preferred alkyl polysaccharides are alkylpolyglycosides of the formula

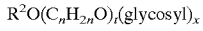

wherein $R^2$ is selected from the group consisting of alkyl, alkylphenyl, hydroxyalkyl, hydroxyalkylphenyl, and mixtures thereof in which alkyl groups contain from about 10 to about 18, preferably from about 12 to about 14, carbon atoms; n is 0 to 3, preferably 2; t is from 0 to about 10, preferably 0; and x is from 1.3 to about 10, preferably from 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Nonionic comprises 0 to 10% by wt. of the composition.

Wheat Protein

The moisturizing protein of the invention is a cationic wheat protein wherein said wheat protein has a structure defined as follows:

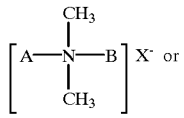

or

-continued

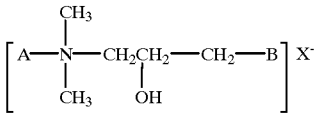

wherein A is

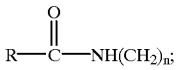

or $CH_3(CH_2)_m$;

wherein R is $CH_3(CH_2)_m$;

n=0 to 5; and m=8 to 22;

B is hydrolyzed wheat protein and $X^-$ is an anion such as for example chloride, bromide or other halogen.

In preferred embodiment,

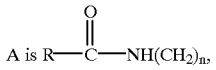

where

R is the fatty group derived from wheat germ oil, and n=1 to 5.

Also, in preferred embodiment, $X^-$ is $Cl^-$.

In general, fatty acid distribution for wheat germ oil is mixture of saturated and unsaturated $C_{16}$ and saturated and unsaturated $C_{18}$ groups (e.g., unsaturated include oleic, linoleic and linolenic). A typical example is:

| | |
|---|---|
| Saturated | |
| $C_{16}$ | 16.6% |
| $C_{18}$ | 0.5% |
| Monosaturated | |
| C16:1 | 0.5% |
| C18:1 (oleic) | 14.6% |
| Polysaturated | |
| C18:2 (linoleic) | 54.8% |
| C18:3 (linolenic) | 6.9% |

Antibacterial Agent

Suitable antibacterial agents which may be used in the subject invention (i.e., in one embodiment of the invention) include:

2-hydroxy-4,2',4'-trichlorodiphenylether (DP300);

2,6-dimethyl-4-hydroxychlorobenzene (PCMX);

3,4,4'-trichlorocarbanilide (TCC);

3-trifluorometlhyl-4,4'-dichlorocarbanilide (TFC);

2,2'-dihydrodxy-3,3',5,5',6,6'-hexachlorodiphenylmethane;

2,2'-dihydroxy-3,3'5,5'-tetrachlorodiphenylmethane;

2,2'-dihydroxy-3,3',dibromo-5,5'-dichlorodiphenylmethane;

2-hydroxy-4,4'-dichlorodiphenylether;

2-hydroxy-3,5',4-tribromodiphenylether; and 1-hydroxyl-4-methyl-6-(2,4,4-trimethylpentyl)-2(1 H)-pyridinone (Octopirox).

Other suitable antimicrobials include:

Benzalkonium chloride;

Benzethonium chloride;

Carbolic acid;

Cloflucarbon (Irgasan CF3;4,4'-dichloro-3-(trifluoromethyl)carbanilide);

Chlorhexidine (CHX; 1,6-di(4'-chlorophenyl-diguanido) hexane);

Cresylic acid;

Hexetidine (5-amino-1,3-bis(2-ethylhexyl)-5-methylhexahydropyrimidine);

Iodophors;

Methylbenzethonium chloride;

Povidone-iodine;

Tetramethylthiuram disulfide (TMTD; Thiram);

Tribrominated salicylanilide.

In preferred embodiments, the compositions of the invention will also contain 0.1 to 5.0%, preferably 0.1 to 3% by wt. of a humectant. Examples of such humectants include low molecular weight alcohols such as ethanol, butanol or low molecular weight PEGs; or glycerin.

In another preferred embodiment, the compositions will also contain about 0.05 to 3% of a second cationic polymer.

In principle, the cationic polymers used in the process and compositions of the invention may be any polymer of the polyamine, polyaminoamide, or quaternary polyammonium type, with the amine or ammonium group constituting part of the polymer chain or being bonded thereto. Example of these are any of the cationic polymers described in U.S. Pat. No. 4,438,095, hereby incorporated by reference into the subject application.

Cationic polymers include derivatives of cellulose ethers entailing quatemary ammonium groupings such as those described in French patent No.1,492,597 such as, for example, polymers sold under the designation JR (e.g., JR 125, JR 400, JR 30M) and LR (e.g., LR 500 and LR 30M) by Union Carbide under the designation CELQUAT by National Starch Company; and cationic polysaccharides such as those described in U.S. Pat. No. 3,509,978 or U.S. Pat. No. 4,031,307, both of which are incorporated herein by reference.

Specific examples of cationic polymers which may be used in the invention are a glycidyltrimethylammonium chloride ether of hydroxyethylcellulose (Polymer JR400, Union Carbide), a quaternary ammonium salt of a polyvinylpyrrolidone derivative (Gafcoat 734, GAF), polydimethylmethylenepyrelidinium chloride (Merquat 100, Merck), a quatemary ammonium derivative of hydroxy propyl guar (Jaguar C-13-S, or Rhodia which is more specifically guar hydroxy propyl trimethyl ammonium chloride, and a quaternary ammonium salt of hydrolyzed gelatin (Crodine Q, Croda).

In addition, other ingredients which may be used include viscosity modifier (e.g., salts; polysorbate), pearlizers (e.g., glycol stearate, mica), perfumes, vitamins, preservatives, dyes and water. Water generally comprises 50 to 95% of the compositions.

The compositions of the invention which include the cationic proteins of the invention generally have zein solubilities of under 40, preferably under 30 and most preferably under 25 using zein solubility method set forth in the examples. The lower the zein score, the milder the product is considered to be.

Except in the operating and comparative examples, or where otherwise explicitly indicated, all numbers in this description indicating amounts or ratios of materials or conditions or reaction, physical properties of materials and/or use are to be understood as modified by the word "about".

Where used in the specification, the term "comprising" is intended to include the presence of stated features, integers, steps, components, but not to preclude the presence or addition of one or more features, integers, steps, components or groups thereof.

The following examples are intended to further illustrate the invention and are not intended to limit the invention in any way.

Unless indicated otherwise, all percentages are intended to be percentages by weight.

EXAMPLES

The following formulations were prepared as an example of the compositions of the invention and comprise as follows:

| Ingredient | % by Wt. |
|---|---|
| SLES (sodium lauryl ether sulfate) | About 4.4 |
| Betaine | About 4.4 |
| Cocamide MEA | 1.2 |
| Wheat Protein | 0.25–0.50% |
| Glycerin | 2.0 |
| Cationic Polymer (e.g. Jaguar C13S) | 0.2 |
| Polysorbate 20 | 0.1–1% |
| Perfume, Colorants, Preservatives | .001 to 1% |
| Antibacterial (e.g., Triclosan) | .01–2% |
| Water | To balance |

The formulation is prepared as follows:

Water was added to a beaker and heated to 160° F. The surfactants, SLES, Betaine, cocamide MEA were slowly added one after the other with constant agitation. A glycerin/Jaguar premix was prepared and added to the surfactant. Wheat protein was then added. The mixture was slowly cooled during which time colorants, preservatives were added. At 105° F., perfume and Triclosan were added together as a premix. The mixture was then titrated to the right viscosity with Polysorbate 20.

Protocol for Zein Measurements and Zein Results

The mildness of products can be measured using zein solubilization test. Zein is a corn protein with limited solubility in water. The enhancement of its solubility by anionic surfactants has been correlated with harshness of surfactants towards skin. A harsh surfactant such as SDS causes a large dissolution of zein while a mild product causes a smaller amount of zein to be dissolved. In the zein tests of the invention, 10 g of product and 20 g of water were mixed thoroughly. To this was added 1.5 g of zein, and they were mixed for 1 hour. J The mixture was then centrifuged for 30 minutes at 3000 rpm. After centrifugation, the pellet was extracted, washed with water, and dried in a vacuum oven for 24 hours. The weight of the dried pellet was measured and percent zein solubilized was calculated using the equation.

$$\% \text{ Zein solubilized} = 100\ (1 - \text{weight of dried pellet}/1.5).$$

The % Zein solubilized by the product is an indication of its harshness.

Using the procedure noted above, a formulation as noted above was prepared containing 0.35% of a wheat protein (Wheatgerm Amidopropyl Hydroxypropyl Dimonium Hydrolyzed Wheat Protein) with the tradename Mackpro WLW from McIntyre and 0.4% Polysorbate 20. This composition exhibited a mean zein solubilization of 20%. Without the wheat protein, the product exhibited a zein solubilization of 28.

Example 1

In order to show the advantage using wheat proteins of the invention versus silk proteins, for example, applicants prepared formulations as set forth above where one formulation contained wheat protein (Mackpro WLW) and the other used silk protein (Mackpro NSP).

The formulations were prepared as described above.

Using the formulation, 20 panelists were chosen to conduct skin feel test between the two prototypes and instructed to use the procedure noted below:

Wet your hands and your forearms;

Apply 1 pump of the RIGHT product to your hands;

Lather product in your hands and wash your RIGHT arm;

Rinse—do not dry your hands or arm;

Apply 1 pump of the LEFT product to your hands;

Lather product in your hands and wash your LEFT arm;

Rinse and dry with a towel;

Wait 1 minute and then feel your right and left arms and answer the questions below as to which of the two products perform better on the arm:

Using this procedure, the following questions were answered by 20 panelists with results set forth below:

Wheat Protein Versus Silk Protein

| | Number Preferred | |
|---|---|---|
| | Mackpro WLW | Mackpro NSP |
| Feels less dry and tight | 11 | 9 |
| Feels more moisturized | 10 | 10 |
| Feels softer | 11 | 9 |
| Feels smoother | 12 | 8 |
| Is good for dry skin | 11 | 9 |
| Doesn't dry hands | 13 | 7 |
| Provides essential moisture | 13 | 7 |
| Feels better overall | 11 | 9 |

It can be seen from this data that wheat protein (in the antibacterial containing compositions of the invention) clearly had superior skin "feel" relative to, for example, silk protein.

Example 2

The same test and procedure as in Example 1 was used to compare wheat protein versus milk protein and results for 20 panelists are set forth below:

| | Number preferred | |
|---|---|---|
| | Mackpro WLW | Mackpro MLP |
| Feels less dry & tight | 11 | 9 |
| Feels more moisturized | 13 | 7 |
| Feels softer | 13 | 7 |
| Feels smoother | 12 | 8 |
| Is good for dry skin | 11 | 9 |
| Doesn't dry hands | 11 | 9 |
| Provides essential moisture | 11 | 7 |
| Feels better overall | 12 | 8 |

Again, it can be seen that wheat protein is superior overall, relative to other comparative proteins, in skin "feel" attributes.

What is claimed is:

1. A handwash or personal wash shampoo composition comprising:

(a) 3% to 40% by wt. of a surfactant system comprising surfactants selected from the group consisting of anionic, nonionic and amphoteric/zwitterionic surfactants and mixtures thereof;

wherein said surfactant system must comprise one or more anionic surfactants;

(b) 0.01 to 5% by wt. of a cationic wheat protein wherein said wheat protein has a structure defined as follows:

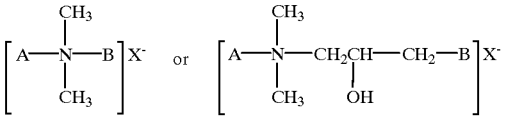

wherein A is R—C—NH $(CH_2)_n$;

or $CH_3(CH_2)_m$;

wherein R is $CH_3(CH_2)_m$;

n=0 to 5; and m=8 to 22;

B is hydrolyzed wheat protein and $X^-$ is an anion; and (c) 0.01 to 3% by wt. of an antibacterial agent.

2. A composition according to claim 1, additionally comprising a humectant.

3. A composition according to claim 2, wherein said humectant is a low molecular weight polyalkylene glycol, glycerine, or $C_2$–$C_4$ alkylene glycol.

4. A composition according to claim 1, wherein, in addition to cationic wheat protein of 1(b), the composition comprises an additional cationic polymer.

5. A composition according to claim 4, wherein additional cationic polymer is guar hydroxy propyl trimethyl ammonium chloride.

6. A composition according to claim 1, comprising 0.05 to 2% of cationic wheat protein (b).

7. A composition according to claim 1, having viscosity of 200 to 25,000 cps.

8. A composition according to claim 1, wherein anion of (b) is a halogen compound.

9. A composition according to claim 8, wherein said halogen is chloride or bromide.

10. A composition according to claim 1 having zein solubility under 40.

* * * * *

UNITED STATES PATENT AND TRADEMARK OFFICE

CERTIFICATE OF CORRECTION

PATENT NO. : 6,117,828 
DATED : September 12, 2000
INVENTOR(S) : Sudhakar Puvvada and Michael Slayton It is certified that error appears in the above-identified patent and that said Letters Patent is hereby corrected as shown below:

Column 11,
Line 18, please change "wherein A is R--C--NH $(CH_2)_n$;"
to:

-- 0
wherein A is R--C--NH $(CH_2)_n$; --

Signed and Sealed this

Eighteenth Day of March, 2003

JAMES E. ROGAN
*Director of the United States Patent and Trademark Office*